US007047921B2

(12) United States Patent
Nakamura et al.

(10) Patent No.: US 7,047,921 B2
(45) Date of Patent: May 23, 2006

(54) VARIABLE-VALVE-ACTUATION APPARATUS FOR INTERNAL COMBUSTION ENGINE

(75) Inventors: Makoto Nakamura, Kanagawa (JP); Yoshihiko Yamada, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 8 days.

(21) Appl. No.: 10/627,745

(22) Filed: Jul. 28, 2003

(65) Prior Publication Data

US 2004/0031456 A1 Feb. 19, 2004

(30) Foreign Application Priority Data

Aug. 13, 2002 (JP) ..... 2002-235401

(51) Int. Cl.
*F01L 1/34* (2006.01)

(52) U.S. Cl. ..... 123/90.16; 123/90.15; 123/90.11

(58) Field of Classification Search .. 123/90.15–90.18, 123/90.11, 90.12, 90.39–90.47; 74/568; 475/198–206, 1–10; 476/1–6, 47–60
See application file for complete search history.

(56) References Cited

U.S. PATENT DOCUMENTS 4,802,376 A * 2/1989 Stidworthy ..... 475/16
5,031,582 A * 7/1991 Kruger ..... 123/90.15
5,209,194 A * 5/1993 Adachi et al. ..... 123/90.17
5,357,915 A * 10/1994 Yamamoto et al. ..... 123/90.16
5,778,840 A * 7/1998 Murata et al. ..... 123/90.17
5,979,382 A * 11/1999 Heer ..... 123/90.17
6,138,622 A * 10/2000 Heer ..... 123/90.17
6,167,854 B1 * 1/2001 Regueiro ..... 123/90.17
6,328,006 B1 * 12/2001 Heer ..... 123/90.15
6,550,436 B1 4/2003 Nohara et al.
6,615,777 B1 9/2003 Grau

FOREIGN PATENT DOCUMENTS

DE 1 18 157 2/1976
DE 25 39 510 C3 3/1977
DE 199 05 234 A1 8/2000
DE 200 20 112 U1 3/2001
DE 101 42 257 A1 4/2002
DE 101 20 450 A1 10/2002
JP 2001-3720 A 1/2001

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

A VVA apparatus includes a control shaft arranged rotatable in accordance with the engine operating conditions, an alteration mechanism for changing a lift amount and an operating angle of an engine valve in accordance with rotation of the control shaft, and a drive mechanism for rotating the control shaft and including an electric motor and a reduction mechanism. The reduction mechanism has a reduction ratio set to be larger when the valve is under small lift-amount and operating-angle control than when the valve is under large lift-amount and operating-angle control.

18 Claims, 10 Drawing Sheets

VARIABLE-VALVE-ACTUATION APPARATUS FOR INTERNAL COMBUSTION ENGINE

BACKGROUND OF THE INVENTION

The present invention relates to a variable-valve-actuation (VVA) apparatus for an internal combustion engine, which can vary at least the operating angle of engine valves such as an intake valve and an exhaust valve in accordance with engine operating conditions.

Typically, the VVA apparatus applied to intake valves comprises a crank cam arranged at the outer periphery of a driving shaft that rotates in synchronism with a crankshaft and having an axis eccentric to an axis of the driving shaft, and a valve operating (VO) cam to which torque of the crank cam is transmitted through a transmission mechanism to have a cam face coming in slide contact with the top face of a valve lifter arranged at the upper end of the intake valve for opening operation thereof against a biasing force of a valve spring.

The transmission mechanism includes a rocker arm disposed above the VO cam and swingably supported to a control shaft, a crank arm having an annular first end engaged on the outer peripheral surface of the crank cam and a second end rotatably connected to a first arm of the rocker arm through a pin, and a link rod having a first end rotatably connected to a second arm of the rocker arm through a pin and a second end rotatably connected to a cam nose of the VO cam through a pin.

The control shaft is driven, for example, by an electric motor through a worm gear or reduction mechanism provided to a driving shaft of the motor. Fixed on the outer peripheral surface of the control shaft is a control cam having an axis eccentric to an axis of the control shaft by a predetermined amount and rotatably fitted in a support hole formed substantially in the center of the rocker arm. The control cam changes a rocking fulcrum of the rocker arm in accordance with the rotated position to change the position of contact of the cam face of the VO cam with respect to the top face of the valve lifter, carrying out variable control of the lift amount and operating angle of the intake valve.

Specifically, when the engine operating conditions are in the low-rotation range, for example, the control shaft is rotated in one direction through the motor to rotate the control cam in the same direction, moving the rocking fulcrum of the rocker arm in the direction of separating from the driving shaft. Then, a pivotal point of the rocker arm with the link rod is moved upward to draw up the cam nose of the VO cam, moving the position of contact of the VO cam with respect to the top face of the valve lifter in the direction of separating from a lift portion of the VO cam. Thus, the intake valve is controlled to minimize the lift amount and the operating angle.

On the other hand, when the engine operating conditions pass from the low-rotation range to the high-rotation range, the control shaft is rotated in another direction by the motor to rotate the control cam in the same direction, moving the rocking fulcrum of the rocker arm in the direction of approaching the driving shaft. Then, the cam nose of the VO cam is pushed downward by the link rod, etc. to move the position of contact of the VO cam with respect to the top face of the valve lifter to the lift portion of the VO cam. Thus, the intake valve is controlled to increase the lift amount and the operating angle.

Therefore, outstanding engine performance such as improved fuel consumption, increased engine output, or the like can be obtained in accordance with the engine operating conditions.

With the VVA apparatus, however, referring to FIG. 8, the worm gear arranged to reduce rotation of the motor for control of the control shaft has a reduction ratio which is always constant regardless of the control conditions of the valve-lift amount and the operating angle as shown by broken line. Thus, under small valve-lift and operating-angle control which corresponds to a control area in the ordinary driving range or practical range of the vehicle, the reduction ratio is smaller, leading to greater power consumption of the motor.

Specifically, the reduction ratio obtained from the angular velocities of the driving shaft of the motor and the control shaft corresponds to a torque ratio of the motor, which is proportional to current supplied thereto. Therefore, under small valve-lift and operating-angle control, the reduction ratio is not increased and thus smaller, leading to greater torque of the motor for rotating the control shaft. This increases power consumption during ordinary driving of the vehicle, resulting in a harmful effect on fuel consumption of the internal combustion engine which also serves to drive accessories such as an alternator.

Further, if power supplied to the motor is smaller due to reduction in storage amount of a battery for supplying power to the motor, a technical problem can occur such as deterioration of the rotation-ability of the motor in the ordinary driving range of the vehicle.

Furthermore, since the reduction ratio is not decreased and thus constant during the transition from small valve lift to large valve lift, which occurs at quick acceleration of the vehicle and the like, the total number of revolutions of the motor required for this transition cannot be reduced, causing longer transition time, resulting in possible lowering of the switching responsivity from small valve lift to large valve lift.

SUMMARY OF THE INVENTION

It is, therefore, an object of the present invention to provide a VVA apparatus for an internal combustion engine, which allows a reduction in power consumption of the motor under small lift-amount and operating-angle control, and an enhancement in switching responsivity when control is switched from small lift-amount and operating-angle control to large lift-amount and operating-angle control.

The present invention provides generally a variable-valve-actuation (VVA) apparatus for an internal combustion engine with a valve, which comprises: a control shaft arranged rotatable in accordance with operating conditions of the engine; an alteration mechanism which changes at least an operating angle of the valve in accordance with rotation of the control shaft; and a drive mechanism which rotates the control shaft, the drive mechanism comprising an electric motor and a reduction mechanism, the reduction mechanism having a reduction ratio set to be larger when the valve is under control of small operating angle than when the valve is under control of large operating angle.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
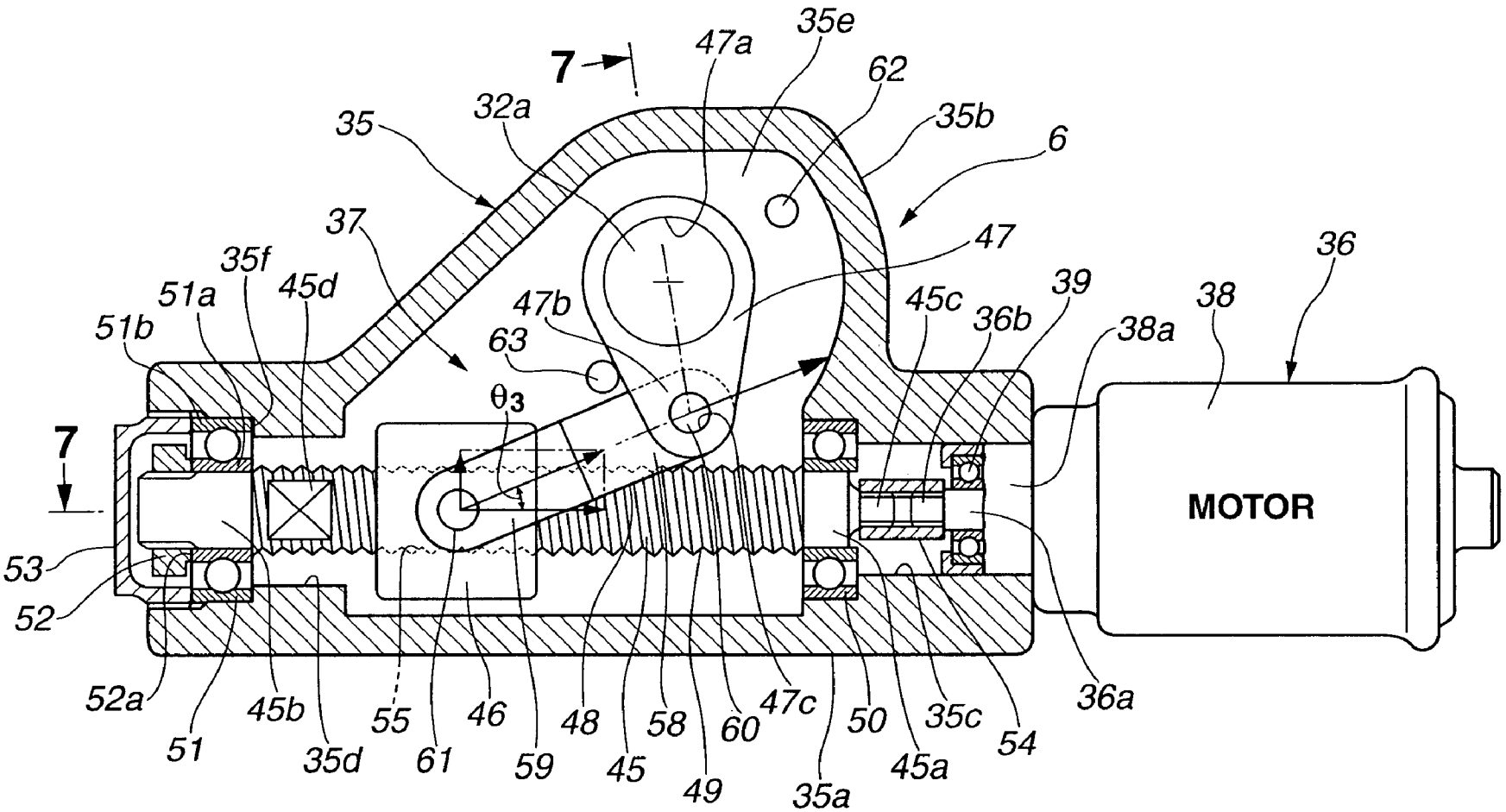
FIG. 1 is a longitudinal sectional view showing a first embodiment of a VVA apparatus for an internal combustion engine according to the present invention.

Referring to the drawings, a description is made about a VVA apparatus for an internal combustion engine embodying the present invention. In the illustrative embodiments, the VVA apparatus is applied to an internal combustion engine including two intake valves per cylinder, the valve-lift amount and operating angle of each being varied in accordance with the engine operating conditions.

Referring to FIGS. 2–5B, there is shown first embodiment of the present invention. The VVA apparatus includes a pair of intake valves 2 slidably provided to a cylinder head 1 through valve guides, not shown, and biased in the closed direction by valve springs 3, an alteration mechanism 4 for varying the lift amount of intake valves 2, a control mechanism 5 for controlling the operating position of alteration mechanism 4, and a drive mechanism 6 for driving control mechanism 5.

Alteration mechanism 4 includes a hollow driving shaft 13 rotatably supported by a bearing 14 in an upper portion of cylinder head 1, a crank or eccentric rotating cam 15 fixed to driving shaft 13 by press fit and the like, a pair of VO cams 17 swingably supported on an outer peripheral surface of driving shaft 13 and coming in slide contact with valve lifters 16 disposed at the upper ends of intake valves 2 for opening operation thereof, and a transmission mechanism connected between crank cam 15 and VO cams 17 for transmitting torque of crank cam 15 to VO cams 17 as a swinging force thereof.

Figure 2:
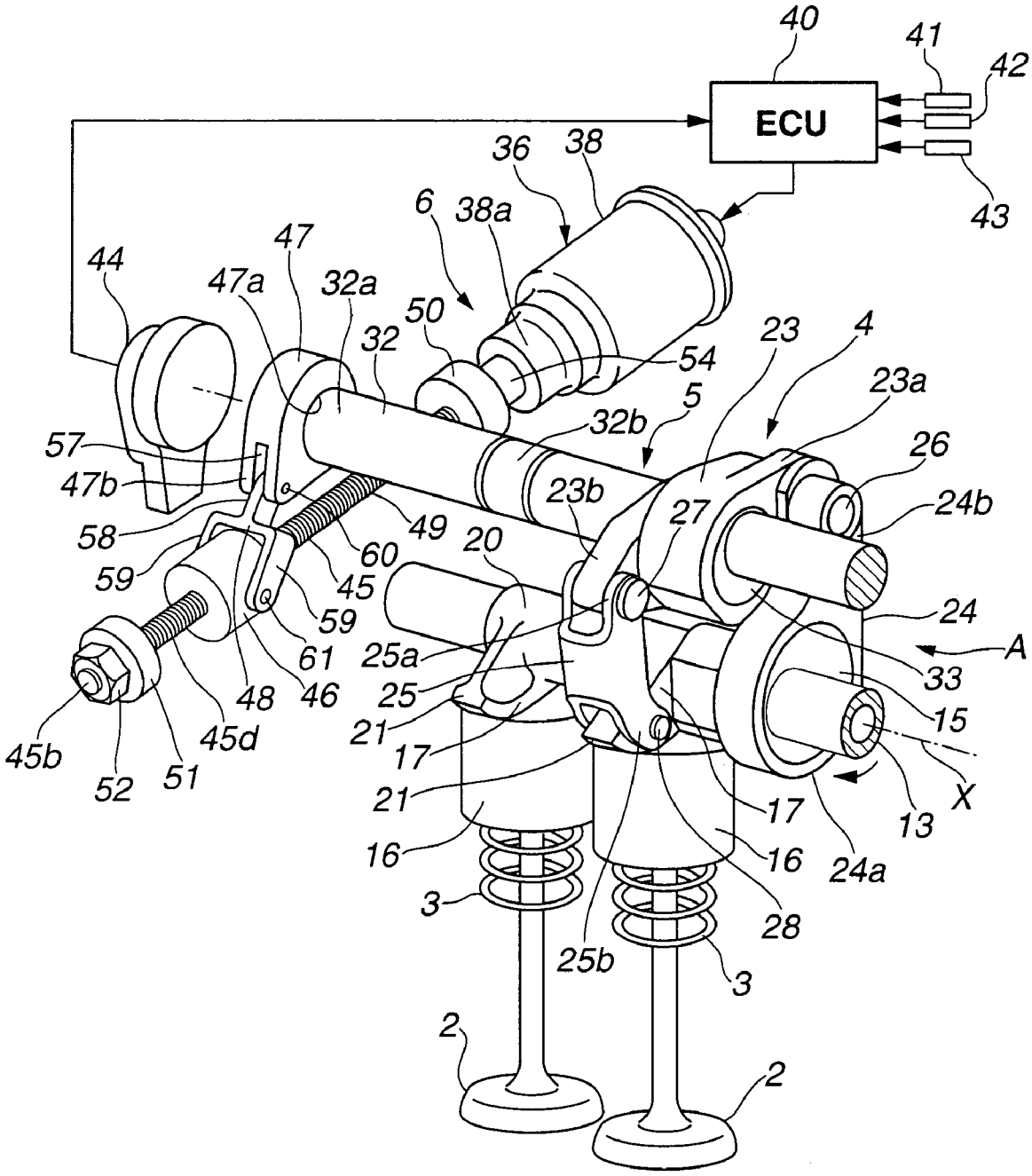
FIG. 2 is a perspective view showing the VVA apparatus.

Referring to FIG. 2, driving shaft 13 extends along the engine longitudinal direction, and has one end with a follower sprocket, a timing chain wound thereon, etc., not shown, through which torque is received from an engine crankshaft. Driving shaft 13 is rotated clockwise or in the direction of arrow as viewed in FIG. 2.

Figure 3A:
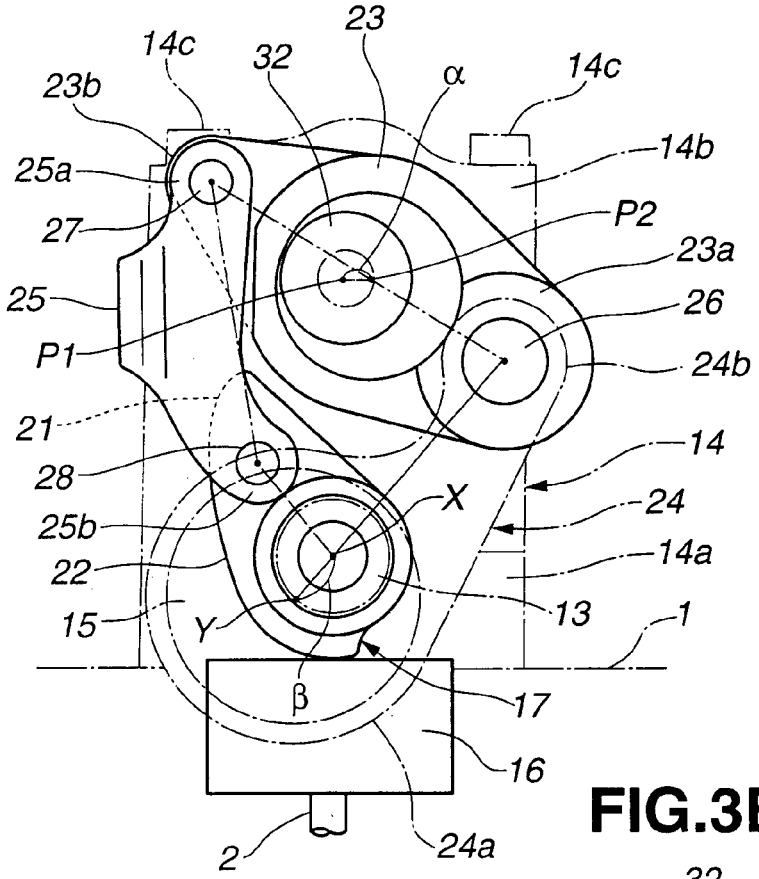
FIGS. 3A and 3B are views seen from arrow A in FIG. 2, showing valve closing operation and valve opening operation during minimum-lift control, respectively.

Referring to FIG. 3A, bearing 14 includes a main bracket 14*a* arranged at the upper end of cylinder head 1 for supporting an upper portion of driving shaft 13, and an auxiliary bracket 14*b* arranged at the upper end of main bracket 14*a* for rotatably supporting a control shaft 32 as will be described later. Brackets 14*a*, 14*b* are fastened together from above by a pair of bolts 14*c*.

Crank cam 15 is formed substantially like a ring, and includes an annular main body and a cylinder integrated with the outer end face thereof. A though hole is formed axially through crank cam 15 to receive driving shaft 13. Referring to FIGS. 3A–5B, an axis Y of the main body of crank cam 15 is offset radially with respect to an axis X of driving shaft 13 by a predetermined amount β. Crank cam 15 is press fitted to one end of driving shaft 13 through the driving-shaft through hole so as not to interfere with valve lifters 16. A cam profile of eccentric circle is formed on the outer peripheral surface of the cam main body.

Valve lifters 16 are formed like a covered cylinder, each being slidably held in a hole of cylinder head 1 and having a flat top face with which VO cam 17 comes in slide contact.

Figure 3B:
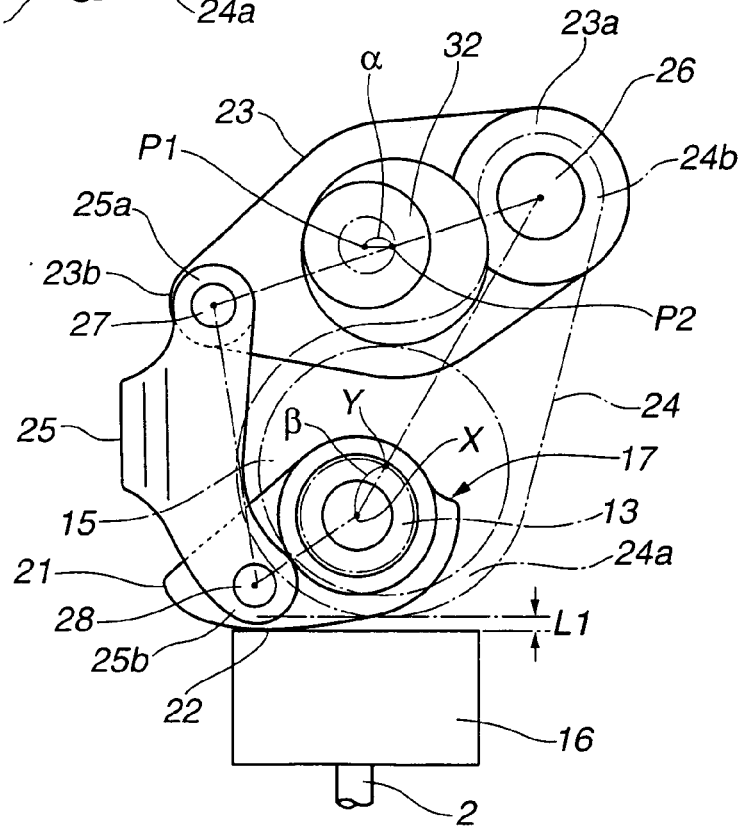

Referring to FIGS. 2–3B, VO cams 17 are both formed roughly like a raindrop, and are integrated with both ends of an annular camshaft 20 with inner peripheral surface through which it is rotatably supported to driving shaft 13. VO cam 17 also has a pin hole on the side of one end or cam nose 21. A lower face of VO cam 17 is formed with a cam face 22 including a base-circle face on the side of camshaft 20, a ramp face circularly extending from the base-circle face to cam nose 21, and a lift face extending from the ramp face to a top face with maximum lift arranged at an end of cam nose 21. The base-circle face, the ramp face, and the lift face come in contact with predetermined points of the top face of valve lifter 16 in accordance with the swinging position of VO cam 17.

Referring to FIGS. 2–5B, transmission mechanism 18 include a rocker arm 23 disposed above driving shaft 13, a crank arm 24 for linking a first arm 23*a* of rocker arm 23 with crank cam 15, and a link rod 25 for linking a second arm 23*b* of rocker arm 23 with VO cam 17.

Rocker arm 23 has in the center a cylindrical base rotatably supported by a control cam 33 as will be described later through a support hole. First arm 23*a* protruding from an outer end of the cylindrical base has a pin hole for receiving a pin 26, whereas second arm 23*b* protruding from an inner end of the cylindrical base has a pin hole for receiving a pin 27 for connecting second arm 23*b* and a first end 25*a* of link rod 25.

Crank arm 24 includes a relatively large-diameter annular base 24*a* and an extension 24*b* arranged in a predetermined position of the outer peripheral surface of base 24*a*. Base 24*a* has in the center an engagement hole 24*c* rotatably engaged with the main body of crank cam 15. Extension 24*b* has a pin hole for rotatably receiving pin 26.

Link rod 25 is formed substantially like a letter L having a concave on the side of rocker arm 23, and has first and second ends 25*a*, 25*b* formed with pin holes through which ends of pins 27, 28 press fitted in the respective pin holes of second arm 23*b* of rocker arm 23 and cam nose 21 of VO cam 17 are rotatably arranged.

Arranged at one ends of pins 26, 27, 28 are snap rings for restricting axial movement of crank arm 24 and link rod 25.

Control mechanism 5 includes control shaft 32 disposed above driving shaft 13 and rotatably supported on bearing 14, and control cam 33 fixed at the outer periphery of control shaft 32 to form a rocking fulcrum of rocker arm 23.

As best seen in FIG. 2, control shaft 32 is disposed parallel to driving shaft 13 to extend along the engine longitudinal direction, and includes in a predetermined position a journal 32*b* rotatably supported between main bracket 14*a* and auxiliary bracket 14*b* of bearing 14.

Referring to FIGS. 2–5B, control cam 33 is formed like a cylinder, and has an axis P2 offset with respect to an axis P1 of control shaft 32 by an amount a corresponding to a thick portion.

Referring to FIGS. 1, 2, 6, and 7, drive mechanism 6 comprises a housing 35 fixed to the rear end of cylinder head 1, an electric motor or torque providing means 36 fixed to one end of housing 35, and a screw transmission mechanism or reduction mechanism or means 37 arranged in housing 35 for reducing and transmitting torque of motor 36 to control shaft 32.

Housing 35 comprises a cylinder 35*a* disposed along the direction substantially perpendicular to axis P1 of control shaft 32, an expansion 35*b* protruding upward from the center of the upper end of cylinder 35*a*, and a side wall 35*c* for closing one side of cylinder 35*a* and expansion 35*b*.

Motor 36 comprises a proportional-type DC motor, and includes a casing 38 having at one end a small-diameter portion 38*a* engaged in a first opening 35*c* of cylinder 35*a* by press fit and the like, and a driving shaft 36*a* supported by a ball bearing 39 arranged in small-diameter portion 38*a*.

Moreover, motor 36 is driven in accordance with a control signal of an electronic control unit (ECU) 40 for determining the engine operating conditions. ECU 40 receives sensed signals out of a crank angle sensor 41 for sensing engine speed, an airflow meter 42 for sensing an intake air amount, a coolant-temperature sensor 43 for sensing an engine coolant temperature, a potentiometer 44 for sensing a rotated position of control shaft 32 to determine actual engine operating conditions by computing and the like, thus carrying out feedback control of motor 36.

Figure 6:
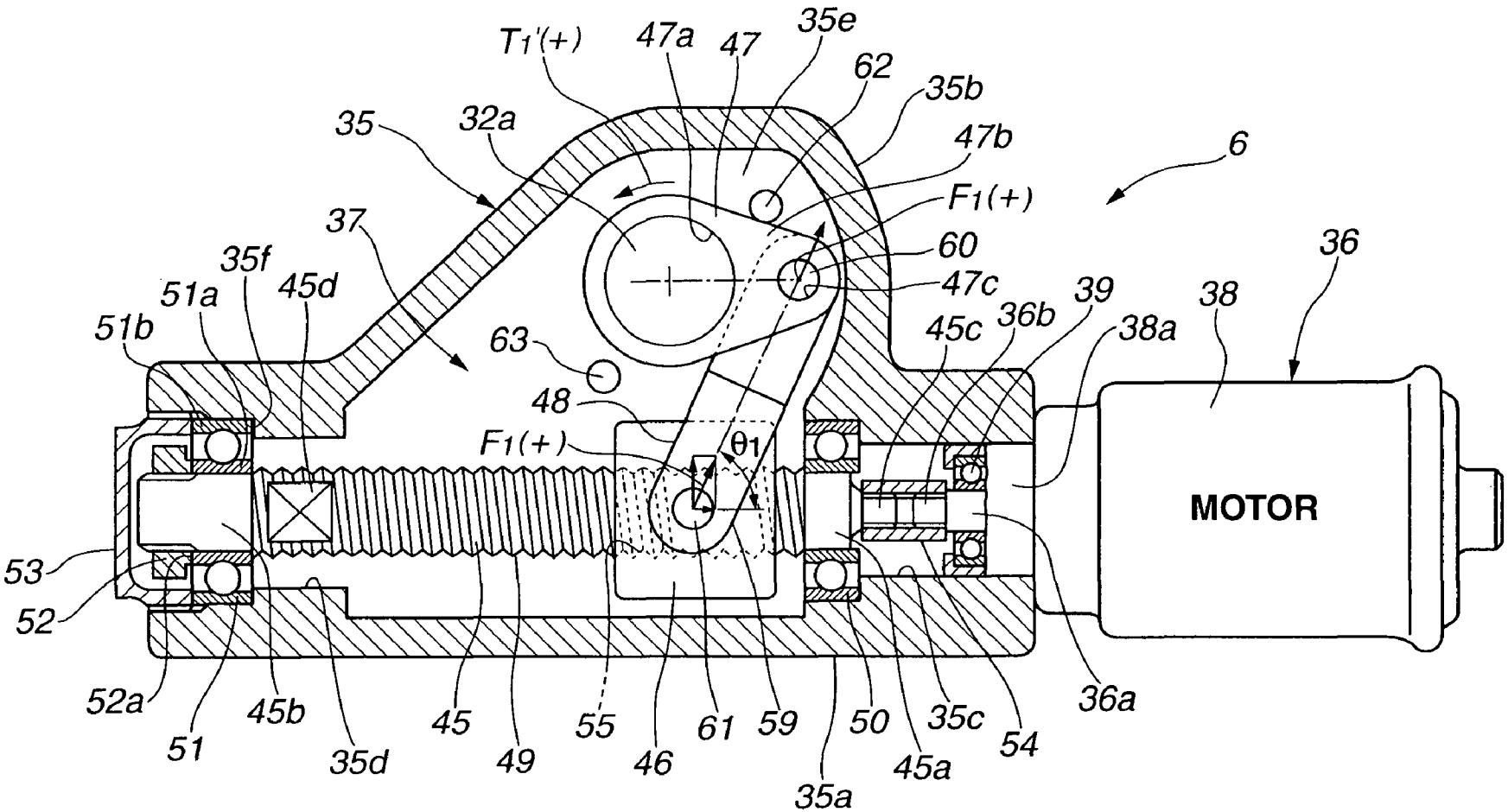
FIG. 6 is a view similar to FIG. 1, explaining operation of a drive mechanism during minimum-lift control.
Figure 7:
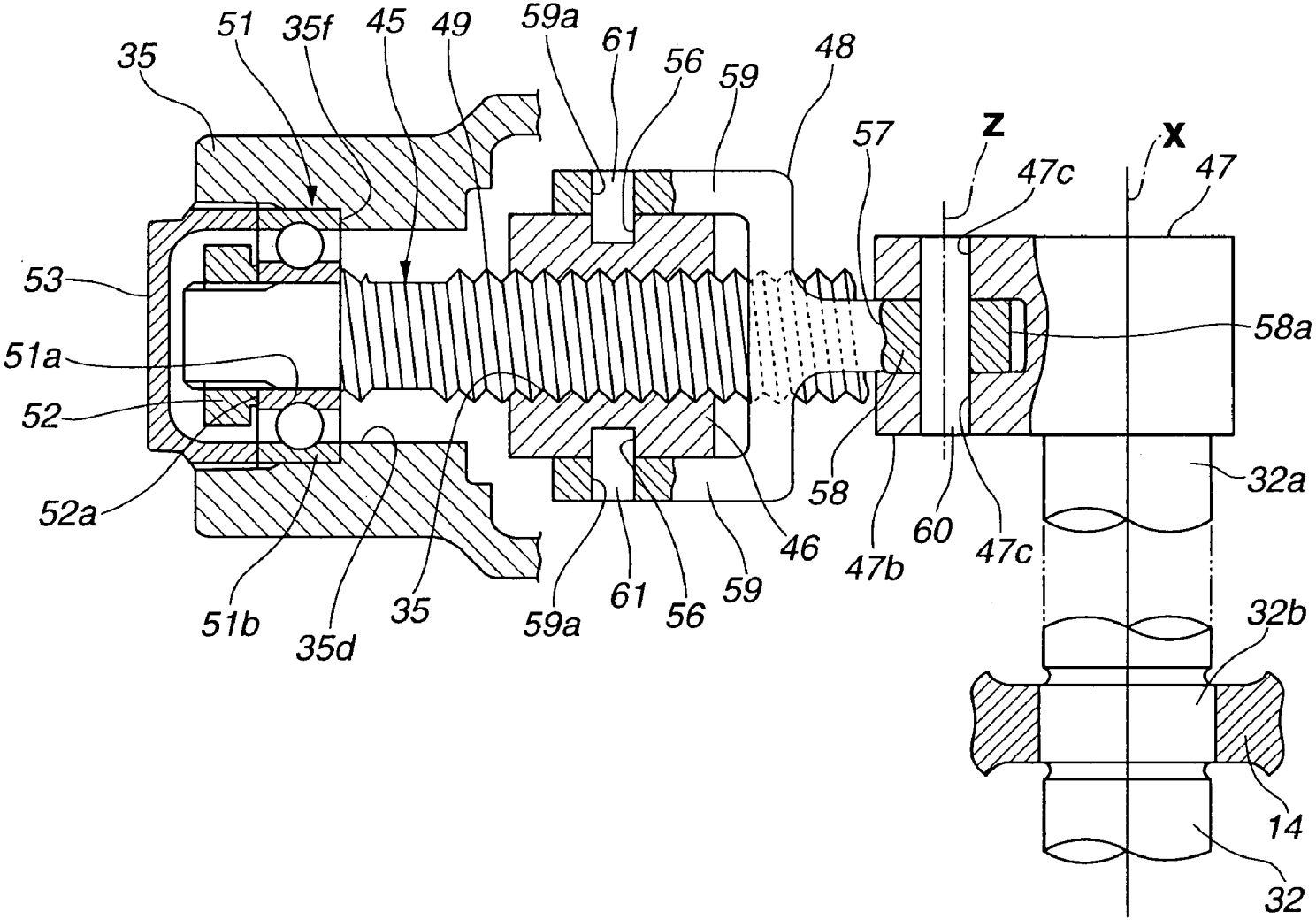
FIG. 7 is a sectional view taken along the line 7—7 in FIG. 1.

Referring to FIGS. 1, 6, and 7, screw transmission mechanism 37 comprises essentially a threaded shaft or output shaft 45 arranged in cylinder 35*a* of housing 35 to be roughly coaxial with driving shaft 36*a* of motor 36, a threaded nut or moving member 46 meshed with the outer periphery of threaded shaft 45, a link arm or linkage 47 arranged in housing 35 and fixed to the outer periphery of one end of control shaft 32, and a link member 48 for linking link arm 47 to threaded nut 46.

Threaded shaft 45 has an external thread or engagement 49 continuously formed on the entire outer peripheral surface except ends 45*a*, 45*b* which face first and second openings 35*c*, 35*d* of cylinder 35*a* to rotatably be supported by ball bearings 50, 51.

A nut 52 is meshed with a tip of second end 45*b* of threaded shaft 45 to hold threaded shaft 45 in cylinder 35*a* of housing 35. Nut 52 is formed at one end with a protrusion 52*a* for pressing an inner ring 51*a* of ball bearing 51 against a stepped portion of second end 45*b* of threaded shaft 45 for fixing. Nut 52 is rotated together with threaded shaft 45. A dish-like cap 53 is secured to second opening 35*d* of cylinder 35*a*, and has a cylindrical front end through which an outer ring 51*b* of ball bearing 51 is pressed and fixed to stepped portion 35*f* of second opening 35*d*.

Two engagement faces 45*d* are formed in second end 45 of threaded shaft 45, with which a holding jig is engaged to prevent rotation of threaded shaft 45 when fastening nut 52 by a given jig such as spanner.

Threaded shaft 45 has at first end 45*a* a small-diameter shaft 45*c* serration-coupled coaxially to a small-diameter portion 36*b* of driving shaft 36*a* of motor 36 through a cylindrical coupling member 54 so as to be movable axially.

Specifically, first serrations are axially formed on the outer peripheral surfaces of small-diameter shaft 45*c* and small-diameter portion 36*b*, whereas a second serration is formed on the inner peripheral surface of coupling member 54 to loosely engage with the first serrations. Such serration coupling allows transmission of torque of motor 36 to threaded shaft 45, and slight axial movement of threaded shaft 45.

Threaded nut 46, which is formed substantially like a cylinder, has on the entire inner peripheral surface an internal thread 55 meshed with external thread 45 to convert torque of threaded shaft 45 into an axial moving force, and also has at both ends roughly in the axial center pin holes 56 to extend along the diametral direction as shown in FIG. 7.

Referring to FIGS. 1 and 2, link arm 47, which is formed substantially like a raindrop, has fixing hole 47*a* formed through a large-diameter base to receive one end 32*a* of control shaft 32, and is fixed to one end 32*a* by a bolt, not shown. As shown in FIG. 7, link arm 47 has a tapered tip 47*b* with a slit 57 formed in the center in the cross direction thereof. Two pin holes 47*c* are formed through tip 47*b* to extend continuously along the direction of control shaft 32. Therefore, an axis Z of pin holes 47*c* is offset with respect to axis P1 of control shaft 32.

Referring to FIG. 7, link member 48 is formed substantially like a letter Y, and has a plate-like first end 58 and bifurcated second ends 59. First end 58 is arranged through slit 57 of link arm 47 to rotatably be coupled to tip 47*b* of link arm 47 by a pin 60 arranged through pin holes 47*c* and a pin hole 58*a*. On the other hand, second ends 59 are disposed at both ends of threaded nut 46, and are rotatably coupled to threaded nut 46 through pin holes 59*a* formed oppositely and pin shafts 61 arranged through pin holes 56 of threaded nut 46. Pin 60 has both ends engaged in pin holes 47*c* of link arm 47, and a center slidably arranged in pin hole 58*a* of link member 48. On the other hand, pin shafts 61 have outer ends press fitted into pin holes 59*a* of link member 48, and inner ends slidably arranged in pin holes 56 of threaded nut 46.

Referring to FIGS. 1 and 6, first and second stopper pins or restriction mechanisms 62, 63 are arranged inside a side wall 35*e* of housing 35 to restrict the maximum right-left rotated position of control shaft 32 through link arm 47.

Specifically, first stopper pin 62 is fixed in the position of side wall 35*e* where control shaft 32 is rotated counterclockwise as viewed in FIG. 1 to put the lift amount of intake valves 2 at a minimum through alteration mechanism 4. On the other hand, second stopper pin 63 is fixed in the position of side wall 35*e* where control shaft 32 is rotated clockwise as shown in FIG. 1 to put the valve-lift amount at a maximum. First and second stopper pins 62, 63 serve to restrict the counterclockwise and clockwise maximum rotated positions about control shaft 32.

In the position where control shaft 32 has rotation restricted by first stopper pin 62 through link arm 47 as shown in FIG. 6, i.e. in the position where alteration mechanism 4 holds the lift amount of intake valves 2 at a minimum through drive mechanism 6, an angle θ1 formed between an axis of link member 48 and an axis of threaded shaft 45 is a maximum value of about 65°. When control shaft 32 is rotated clockwise as shown in FIG. 1 to control the valve-lift amount at a maximum where further rotation of control shaft 32 is restricted by second stopper pin 63, an angle θ3 formed between the axis of link member 48 and the axis of threaded shaft 45 is a minimum value of about 35°.

Figure 8:
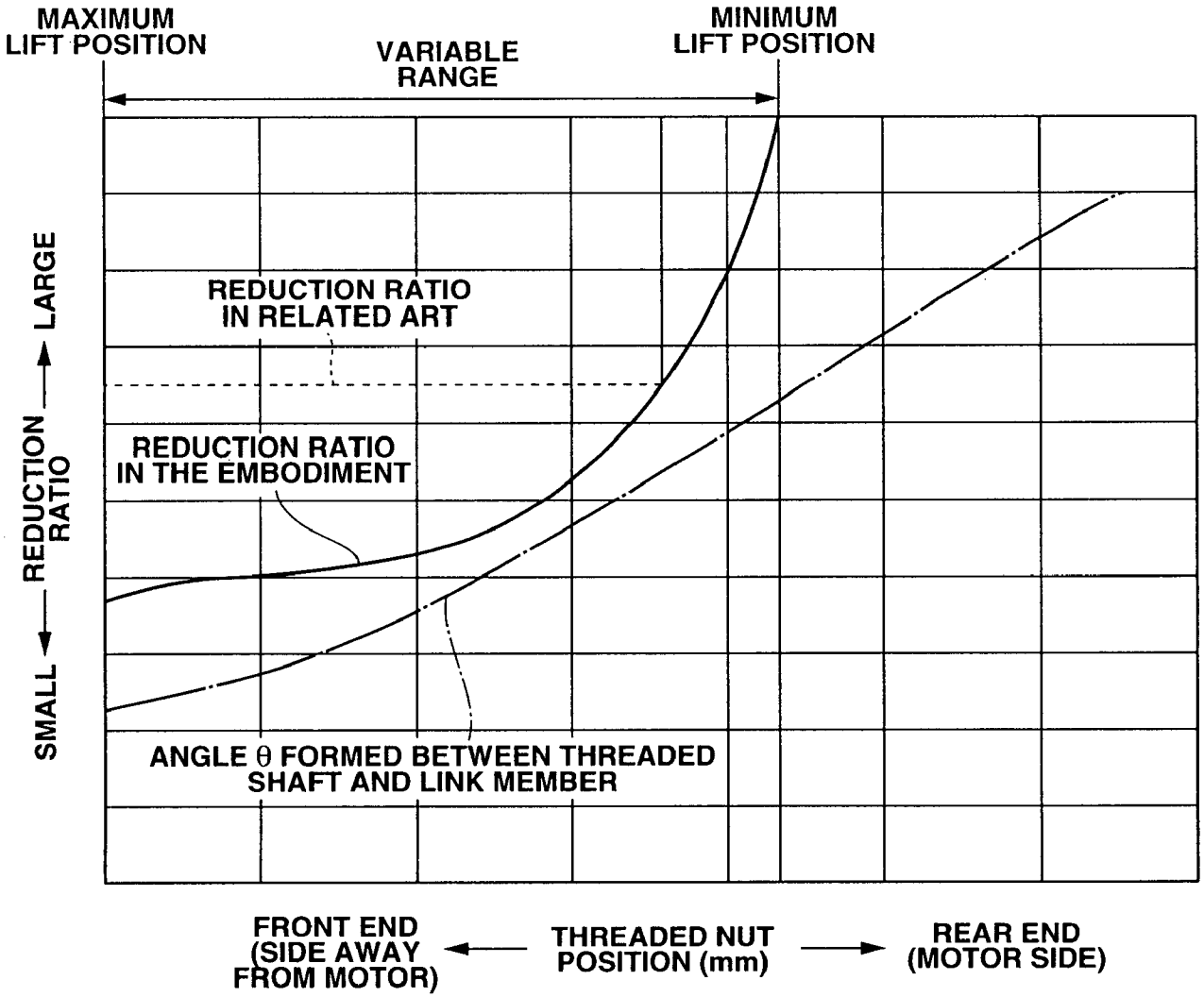
FIG. 8 is a graph illustrating the characteristic of valve-lift amount vs. reduction ratio.

Therefore, referring to FIG. 8, the reduction ratio of screw transmission mechanism 37 with respect to rotation of motor 36 varies angle θ formed between the axis of threaded shaft 45 and the axis of link member 48 as shown by one-dot chain line. Specifically, as shown by solid line, the reduction ratio is larger when angle θ is maximum angle θ1 at minimum lift, and it becomes small abruptly therefrom to minimum angle θ3 at maximum lift.

More specifically, the reduction ratio is determined by the angular velocities of threaded shaft 45 and control shaft 32 as described above. In the small lift area where angle θ is larger, axial movement of threaded nut 46 is not effectively converted into rotation of control shaft 32 due to relationship with link member 48, obtaining larger reduction ratio. On the other hand, in the large lift area where angle θ is smaller, axial movement of threaded nut 46 is effectively converted into rotation of control shaft 32, obtaining smaller reduction ratio.

Operation of the first embodiment is described below. In the engine low-rotation operating range including engine idling, torque provided to motor 36 in accordance with a control signal of ECU 40 is transmitted to threaded shaft 45 for rotation. This rotation moves threaded nut 46 to the rightmost position as shown in FIG. 6, so that control shaft 32 is rotated counterclockwise by link member 48 and link arm 47. Immediately before the side face of threaded nut 46 comes into axial collision and engagement, the side face of tip 47*b* of link arm 47 abuts on first stopper pin 62 to restrict further rotation of control shaft 32. At that time, an impact load can be prevented from occurring at a meshed portion of threaded nut 46 and threaded shaft 45 while securing a movable range of threaded nut 46.

With control cam 33, therefore, axis P2 is rotated on the same radius about axis P1 of control shaft 32 as shown in FIGS. 3A and 3B, having the thick portion moved upward from driving shaft 13. Thus, a pivotal point of second arm 23*b* of rocker arm 23 with link rod 25 is moved upward with respect to driving shaft 13, so that VO cam 17, having cam nose 21 forcibly drawn up through link rod 25, is rotated clockwise in its entirety.

Therefore, when rotation of crank cam 15 pushes first arm 23*a* of rocker arm 23 upward through crank arm 24, a corresponding valve-lift amount L1, transmitted to VO cam 17 and valve lifter 16 through link rod 25, is sufficiently small.

Thus, in the engine low-rotation range, the valve-lift amount is minimum to delay an opening timing of intake valves 2, obtaining smaller valve overlap with the exhaust valves. This leads to enhanced fuel consumption and stable engine rotation.

Figure 4A:
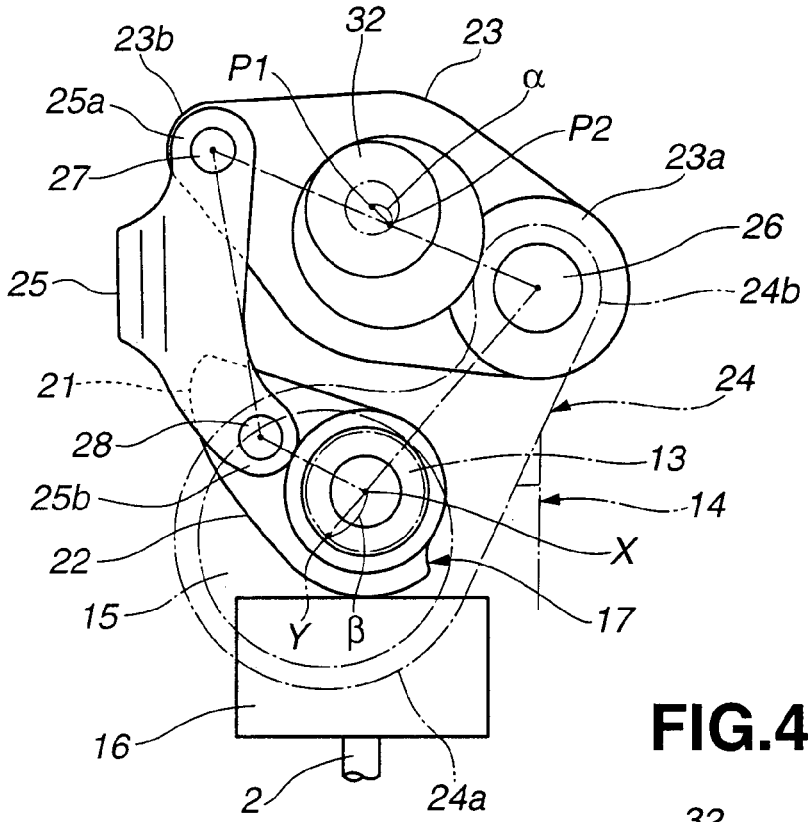
FIGS. 4A and 4B are views similar to FIG. 3B, seen from arrow A in FIG. 2, showing valve closing operation and valve opening operation during medium-lift control, respectively.
Figure 4B:
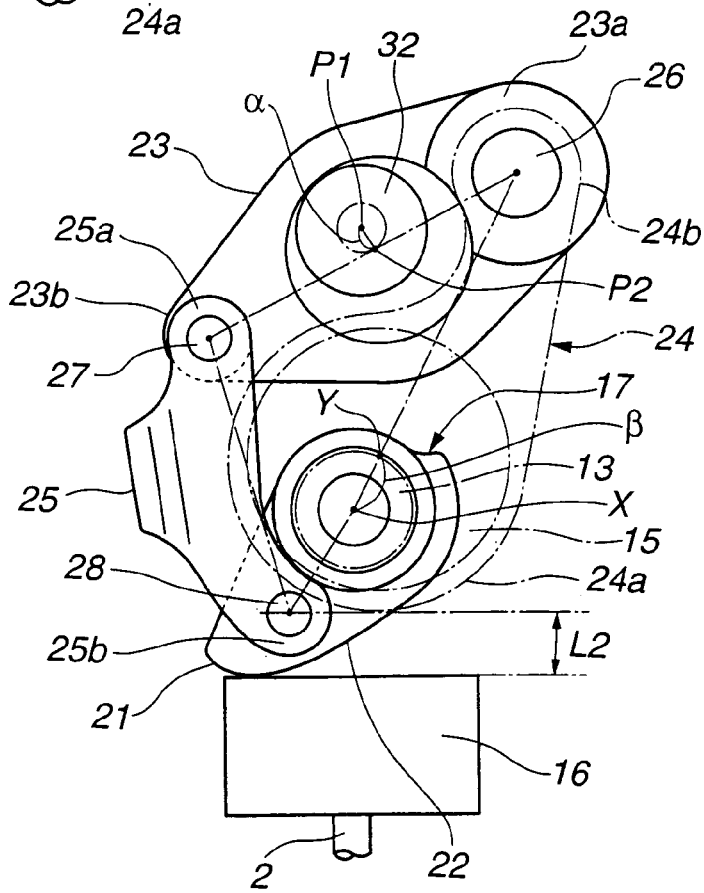

When the engine proceeds to the medium-rotation range, motor 36 is rotated in the reverse direction in accordance with a control signal of ECU 40 to provide torque to threaded shaft 45 for rotation. This rotation moves threaded nut 46 leftward from the position shown in FIG. 6. Therefore, control shaft 32 rotates control cam 33 clockwise from the position shown in FIGS. 3A and 3B to rotate axis P2 slightly downward as shown in FIGS. 4A and 4B. As a result, rocker arm 23 in its entirety is moved in the direction of driving shaft 13, so that second arm 23*b* pushes cam nose 21 of VO cam 17 downward through link rod 25, rotating VO cam 17 in its entirety counterclockwise by a predetermined amount.

Therefore, when rotation of crank cam 15 pushes first arm 23*a* of rocker arm 23 upward through crank arm 24, a corresponding valve-lift amount L2, transmitted to VO cam 17 and valve lifter 16 through link rod 25, is slightly large.

The reduction ratio at that time is slightly smaller than that in the minimum lift area. However, since angle θ formed between threaded shaft 45 and link member 48 is relatively large, the reduction ratio is also large, thus achieving small power consumption.

When the engine proceeds to the high-rotation range at quick acceleration and the like, motor 36 is further rotated in the reverse direction in accordance with a control signal of ECU 40 which detects this operating condition through various sensors such as engine-speed sensor 41 further rotating threaded shaft 45 in the same direction. This rotation moves threaded nut 46 leftward as shown in FIG. 1, so that angle θ formed between threaded shaft 45 and link member 48 is sufficiently small. Moreover, at that time, immediately before the side face of threaded nut 46 comes into axial collision and engagement, further rotation of control shaft 32 is restricted in the position where the side face of link arm 47 abuts on second stopper pin 63. Further, damage of threaded nut 46 due to collision can be prevented while securing a movable range of threaded nut 46. Further movement of threaded nut 46 is also restricted, so that angle θ3 formed between threaded shaft 45 and link member 48 is minimum.

Figure 5A:
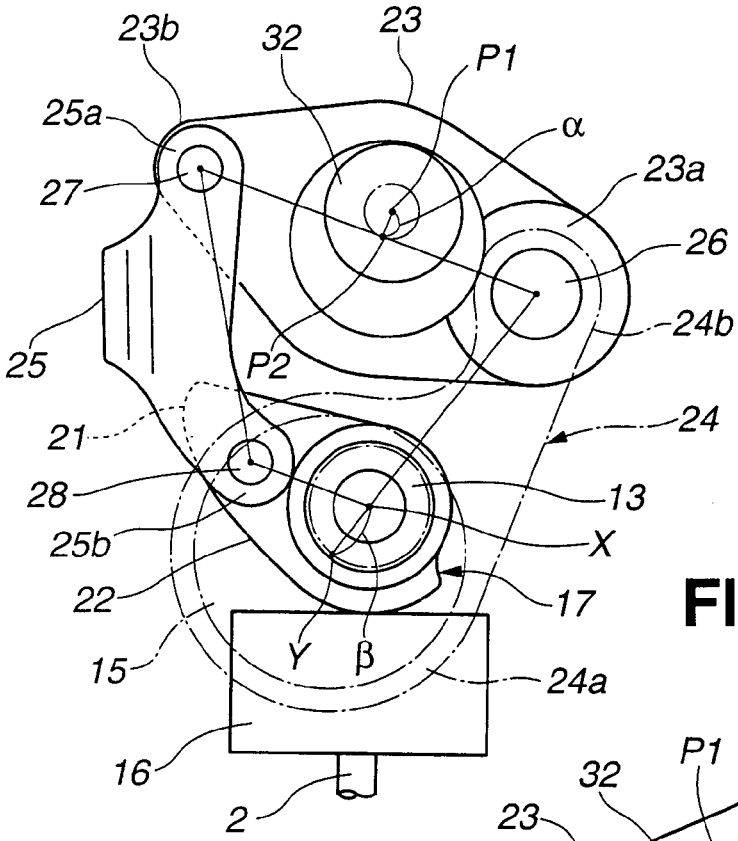
FIGS. 5A and 5B are views similar to FIG. 4B, seen from arrow A in FIG. 2, showing valve closing operation and valve opening operation during maximum-lift control, respectively.
Figure 5B:
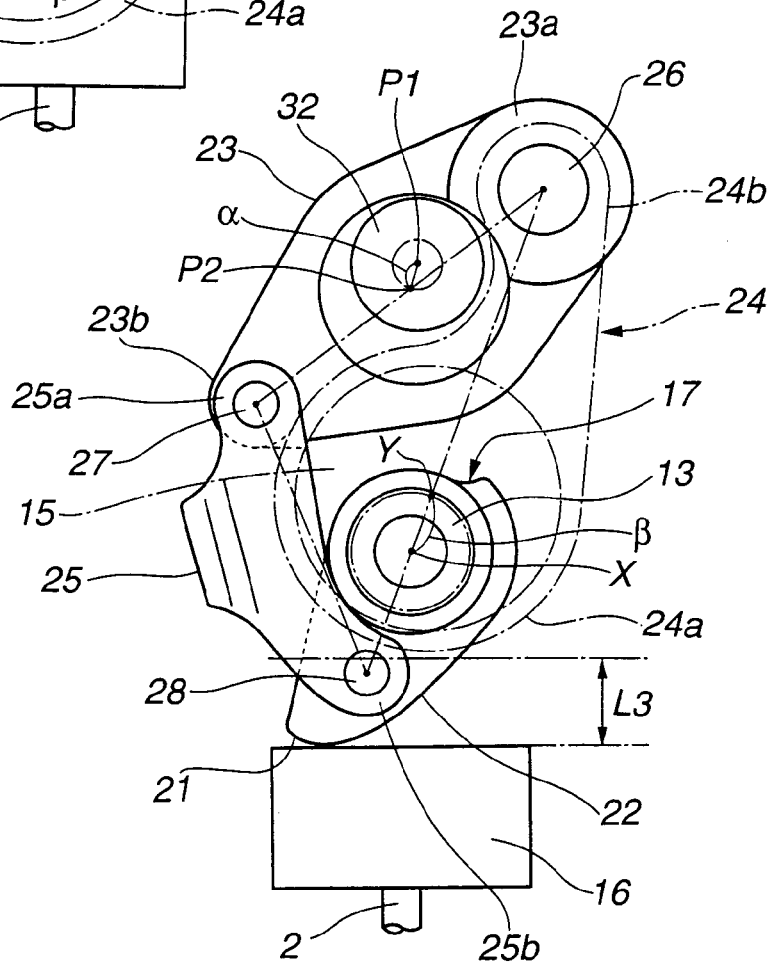

With such operation, control shaft 32 rotates control cam 33 clockwise from the position shown in FIGS. 4A and 4B to rotate axis P2 downward as shown in FIGS. 5A and 5B. As a result, rocker arm 23 in its entirety is moved in the direction of driving shaft 13, so that second arm 23*b* pushes cam nose 21 of VO cam 17 downward through link rod 25, rotating VO cam 17 in its entirety counterclockwise by a predetermined amount.

Therefore, the position of contact of cam face 22 of VO cam 17 with respect to the top face of valve lifter 16 is moved rightward or in the direction of the lift portion. As a result, when rotation of crank cam 15 pushes first arm 23*a* of rocker arm 23 through crank arm 24, a corresponding lift amount L3 with respect to valve lifter 16 is larger than medium valve-lift amount L2.

Thus, in the engine high-rotation range, the valve-lift amount is maximum to advance an opening timing and delay a closing timing of intake valves 2, leading to enhancement in intake-air charging efficiency and thus achievement of sufficient engine output.

As described above, in a predetermined small area of minimum lift or more of intake valves 2 which corresponds to the practical range of the vehicle, the reduction ratio of screw transmission mechanism 37 is sufficiently large, leading to a reduction in torque of motor 36 required to rotate control shaft 32 through threaded nut 46 and link member 48/link arm 47. This allows a sufficient reduction in power consumption of motor 36, having no harmful effect on fuel consumption of the engine which also serves to drive accessories such as an alternator.

Further, due to no reduction in storage amount of a battery for supplying power to motor 36, the power supply amount to motor 36 can be secured, preventing deterioration of the rotation-ability of motor 36 in the ordinary driving range of the vehicle.

Furthermore, during the transition from the small lift area of intake valves 2 to the large lift area thereof, the reduction ratio of screw transmission mechanism 37 is smaller, so that the total number of revolutions of motor 36 required for this transition can be reduced, obtaining reduced transition time, thus preventing deterioration of the switching responsivity from small valve lift to large valve lift.

Further, in the first embodiment, first and second stopper pins 62, 63 are arranged to prevent over-rotation of control shaft 32, allowing not only restraint of one-direction load input of the alternating torque by stopper pins 62, 63 in the rightmost and leftmost moved positions of threaded nut 46, but also excessive movement of threaded nut 46.

Still further, an impact load can be prevented from occurring at a meshed portion of threaded nut 46 and threaded shaft 45 while securing a movable range of threaded nut 46 by stopper pins 62, 63.

Furthermore, nut 52 is engaged with second end 45*b* of threaded shaft 45 to hold inner ring 51*a* of ball bearing 51 between the stepped portions of threaded shaft 45, allowing restraint of accidental axial movement of threaded shaft 45 while maintaining stable and smooth rotation thereof.

Figure 9:
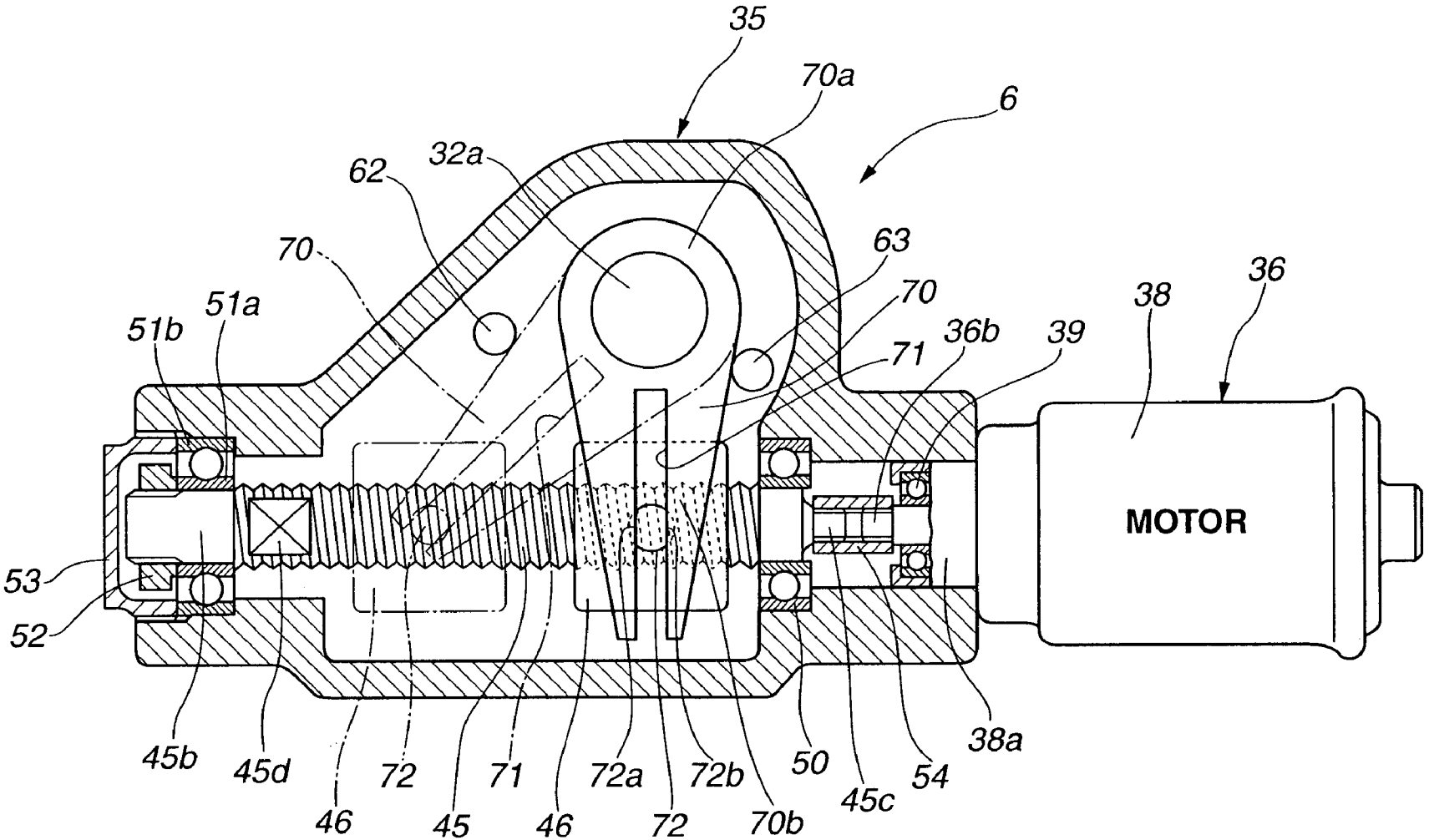
FIG. 9 is a view similar to FIG. 6, showing a second embodiment of the present invention.

Referring to FIG. 9, there is shown second embodiment of the present invention, wherein screw transmission mechanism 37 comprises no link member 48 nor linkage arm 47, but a linkage lever 70 instead of linkage arm 47, which is directly liked to threaded nut 46.

Specifically, linkage lever 70 is formed like an axially long raindrop, and has a base 70*a* fixed to one end 32*a* of control shaft 32, and a slit 71 formed longitudinally substantially in the center of a tip 70*b* extending below one side of threaded nut 46.

On the other hand, threaded nut 46 has a transmission pin 72 rotatably mounted substantially in the axial center of one side. Transmission pin 72 has a base end rotatably supported in support hole radially formed in threaded nut 46, and a tip formed with two engagement faces 72*a*, 72*b* slidably engaged in slit 71.

When linkage lever 70 is located perpendicular (about 90°) to an axis of threaded shaft 45 as shown by solid line in FIG. 9, it abuts on second stopper pin 63 to restrict further counterclockwise rotation, where maximum-lift control is obtained through control shaft 32. That is, the angle of linkage lever 70 with respect to threaded shaft 45 is set to be maximum (about 90°) in the large lift area, achieving minimum reduction ratio. Note that such large angle allows movement of threaded nut 46 to effectively be converted into rotation of linkage lever 70.

On the other hand, when linkage lever 70 is located inclined to threaded shaft 45 by a predetermined angle (about 45°) as shown by one-dot chain line in FIG. 9, it abuts on first stopper pin 62 to restrict further clockwise rotation, where minimum-lift control is obtained. That is, the angle of linkage lever 70 with respect to threaded shaft 45 is set to be minimum (about 45°) in the large lift area, achieving maximum reduction ratio. Note that such small angle allows movement of threaded nut 46 to effectively be converted into rotation of linkage lever 70.

Figure 10:
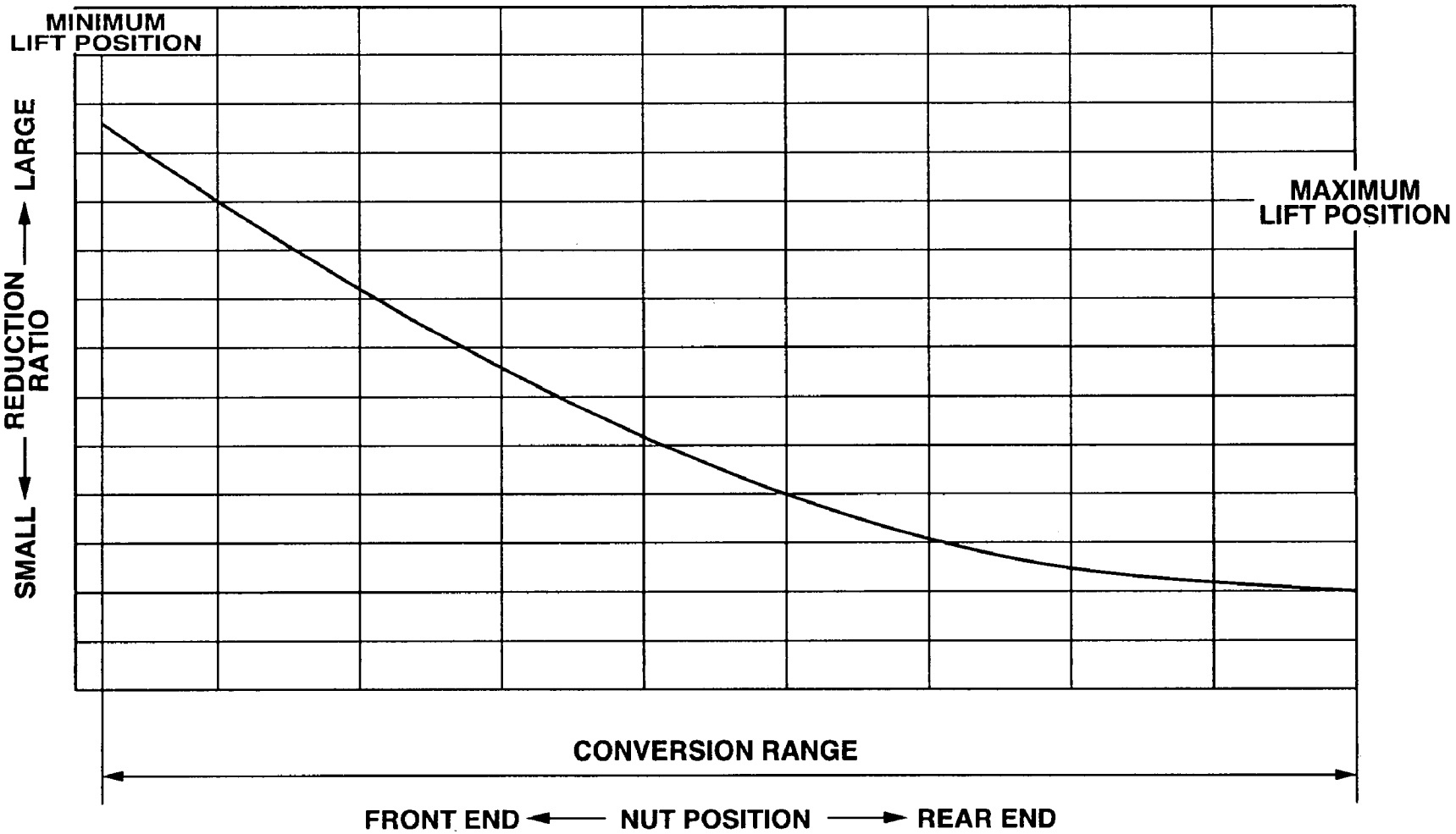
FIG. 10 is a graph similar to FIG. 8, illustrating the characteristic of valve-lift amount vs. reduction ratio in the second embodiment.

In the second embodiment, therefore, when threaded shaft 45 is rotated in the normal or reverse direction by motor 36 to linearly move threaded nut 46 in the axial direction of threaded shaft 45, linkage lever 70 is rotated in the same direction through movement of transmission pin 72 in slit 71. With this, control shaft 32 is rotated clockwise or counterclockwise to control the lift amount and operating angle of intake valves 2. Referring to FIG. 10, the reduction ratio is larger in the small lift area, obtaining smaller power consumption of motor 36. On the other hand, the reduction ratio is smaller in the large lift are, obtaining enhanced switching responsivity through alteration mechanism 4 and control shaft 32 even with larger power consumption.

Therefore, the second embodiment not only produces the same effect as the first embodiment, but also achieves an enhancement in manufacturing and assembling efficiency and thus a reduction in manufacturing cost due to reduced component parts and simplified structure as compared with the first embodiment.

In the above embodiments, threaded shaft 45 of screw transmission mechanism 37 has external thread 49 formed on the outer peripheral surface, whereas threaded nut 46 has internal thread 55 formed on the inner peripheral surface, wherein external thread 49 is meshed with internal thread 55. Optionally, threaded shaft 45 may have a spiral ball groove formed in the outer peripheral surface, whereas threaded nut 46 may have a guide ball groove formed on the inner peripheral surface, wherein the ball groove cooperates with the guide ball groove to hold a plurality of balls in a free-roll manner. In this variation, the use of the balls as means for driving threaded nut 46 allows enhanced moving responsivity and reduced backlash of threaded nut 46 as compared with simple engagement of external and internal threads 49, 55.

As described above, during small valve-lift amount and operating-angle control in the engine low-rotation range, for example, which corresponds to the practical range of the vehicle, the reduction ratio is larger, and thus torque of the motor is smaller, allowing a reduction in power consumption of the motor.

On the other hand, when the engine passes from the low-rotation range to the high-rotation range due to quick acceleration and the like, i.e. control is changed to large valve-lift amount and operating-angle control, the reduction ratio during transition is smaller, and thus torque of the motor is larger, obtaining enhanced switching responsivity even with larger power consumption of the motor. This results in enhancement in acceleration performance of the vehicle.

Further, when the valve is under small operating-angle control, the angle formed between the link member and the output shaft of the reduction mechanism is increased. Thus, an angle of rotation of the linkage linked to the second end of the link member, i.e., an angle of rotation of the control shaft, is reduced with respect to an actual number of revolutions of the output shaft rotated by the motor. That is, the reduction ratio is larger, resulting in smaller torque of the motor and thus power consumption thereof.

On the other hand, when control is changed from small operation-angle control to large operating-angle control, the angle formed between the link member and the output shaft of the reduction mechanism is decreased. Thus, the reduction ratio is smaller, i.e. the angle of rotation of the control shaft is larger, obtaining enhanced rotation responsivity of the linkage, i.e. switching responsivity through the control shaft even with larger torque of the motor. This results in enhancement in acceleration performance of the vehicle.

Still further, the use of the balls as means for driving the moving member allows enhanced moving responsivity and reduced backlash of the moving member as compared with simple engagement of the external and internal threads.

Still further, a maximum reduction effect can be obtained on a radial load acting on the moving member during maximum operating-angle control having larger input, resulting in enhanced durability of the meshed portion of the output shaft and the moving member.

Furthermore, the reduction ratio can be increased, whereas since it is involved in the small lift area having smaller input, a radial load can be decreased though the angle formed between the link member and the output shaft is larger, having no harmful effect on the meshed portion of the output shaft and the moving member.

Further, a maximally moved position of the moving member is restricted by the restriction mechanism immediately before the moving member comes into axial collision, allowing prevention of occurrence of an impact load at the meshed portion of the output shaft and the moving member while securing a movable range of the moving member.

Still further, the moving member is in the non-rotation state, allowing efficient conversion of torque of the output shaft into axial moving force.

Furthermore, it is obtained an enhancement in manufacturing and assembling efficiency and thus a reduction in manufacturing cost due to reduced component parts and simplified structure.

Having described the present invention in connection with the illustrative embodiments, it is noted that the present invention is not limited thereto, and various changes and modifications can be made without departing from the scope of the present invention. By way of example, arrangement of motor 36 can freely be changed in accordance with layout of an engine room, i.e. it can be changed from the right side to the left side as viewed in FIG. 2. Moreover, the present invention can be applied to the exhaust valves and both the intake and exhaust valves.

The entire contents of Japanese Patent Application P2002-235401 filed Aug. 13, 2002 is hereby incorporated by reference.

What is claimed is:

1. A variable-valve-actuation (VVA) apparatus for an internal combustion engine with a valve, comprising:

a control shaft arranged rotatable in accordance with operating conditions of the engine;

an alteration mechanism which changes at least an operating angle of the valve in accordance with rotation of the control shaft; and a drive mechanism which rotates the control shaft, the drive mechanism comprising an electric motor and a reduction mechanism, the reduction mechanism having a reduction ratio set to be larger when the valve is under control of small operating angle than when the valve is under control of large operating angle.

2. The VVA apparatus as claimed in claim 1, wherein the reduction mechanism comprises:

an output shaft linked to the motor and having at an outer periphery an engagement;

a moving member meshed with the engagement of the output shaft, the moving member moving in an axial direction of the output shaft in accordance with rotation of the output shaft;

a link member having a first end swingably linked to the moving member; and a linkage swingably linked to a second end of the link member, the linkage rotating the control shaft by torque transmitted from the link member in accordance with axial movement of the moving member, wherein when the valve is under control of small operating angle, an angle formed between the link member and the output shaft is increased.

3. The VVA apparatus as claimed in claim 1, wherein the alteration mechanism is rotated in synchronism with a crankshaft of the engine, the alteration mechanism comprising a driving shaft having at an outer periphery a crank cam, a valve operating (VO) cam swingably supported on a support shaft and having a cam face which comes in contact with a top face of a valve lifter to carry out opening and closing operation of the valve, and a rocker arm having a first arm mechanically linked to the crank cam and a second arm linked to the VO cam through a link rod, wherein a rocking fulcrum of the rocker arm is changed in accordance with the engine operating conditions to change a position of contact of the VO cam with respect to the top face of the valve lifter, thus varying valve lift.

4. The VVA apparatus as claimed in claim 2, wherein the output shaft of the reduction mechanism comprises a threaded shaft having an external thread formed on an outer peripheral surface, and the moving member comprises a threaded nut having an internal thread formed on an inner peripheral surface, wherein the external thread is meshed with the internal thread.

5. The VVA apparatus as claimed in claim 2, wherein the output shaft of the reduction mechanism comprises a threaded shaft having a spiral ball groove formed in an outer peripheral surface, and the moving member comprises a threaded nut having a guide ball groove formed in an inner peripheral surface, wherein the ball groove cooperates with the guide ball groove to hold a plurality of balls in a free-roll manner.

6. The VVA apparatus as claimed in claim 2, wherein the linkage of the reduction mechanism is fixed to the control shaft, wherein a pivotal point of the linkage with the link member is offset with respect to an axis of the control shaft.

7. The VVA apparatus as claimed in claim 2, wherein when the valve is under control of maximum operating angle, the angle formed between the link member and the output shaft is minimum.

8. The VVA apparatus as claimed in claim 2, wherein when the valve is under control of minimum operating angle, the angle formed between the link member and the output shaft is maximum.

9. The VVA apparatus as claimed in claim 2, further comprising a restriction mechanism which restricts maximum axial movement of the moving member.

10. The VVA apparatus as claimed in claim 2, wherein the moving member is moved axially without being rotated.

11. The VVA apparatus as claimed in claim 1, wherein the reduction mechanism comprises:

an output shaft linked to the motor and having at an outer periphery an engagement;

a moving member meshed with the engagement of the output shaft, the moving member moving in an axial direction of the output shaft in accordance with rotation of the output shaft, the moving member comprising a pin; and a link lever having a first end fixed to the control shaft and a second end formed with a slit, the slit being engaged with the pin, wherein the control shaft is rotated through the link lever in accordance with axial movement of the moving member, and wherein when the valve is under control of small operating angle, an angle formed between the link lever and the output shaft is decreased.

12. A variable-valve-actuation (VVA) apparatus for an internal combustion engine with a valve, comprising:

a control shaft arranged rotatable in accordance with operating conditions of the engine;

an alteration mechanism which changes at least an operating angle of the valve in accordance with rotation of the control shaft; and a drive mechanism which rotates the control shaft, the drive mechanism comprising an electric motor and a reduction mechanism, the reduction mechanism having a reduction ratio set to be larger when the valve is under control of small operating angle than when the valve is under control of large operating angle, the reduction mechanism comprising:

an output shaft linked to the motor and having at an outer periphery an engagement;

a moving member meshed with the engagement of the output shaft, the moving member moving in an axial direction of the output shaft in accordance with rotation of the output shaft;

a link member having a first end swingably linked to the moving member; and a linkage swingably linked to a second end of the link member, the linkage rotating the control shaft by torque transmitted from the link member in accordance with axial movement of the moving member, wherein when the valve is under control of small operating angle, an angle formed between the link member and the output shaft is increased.

13. A variable-valve-actuation (VVA) apparatus for an internal combustion engine with a valve, comprising:

a control shaft arranged rotatable in accordance with operating conditions of the engine;

an alteration mechanism which changes at least an operating angle of the valve in accordance with rotation of the control shaft; and a drive mechanism which rotates the control shaft, the drive mechanism comprising an electric motor and a reduction mechanism, the reduction mechanism having a reduction ratio set to be larger when the valve is under control of small operating angle than when the valve is under control of large operating angle, the reduction mechanism comprising:

an output shaft linked to the motor and having at an outer periphery an engagement;

a moving member meshed with the engagement of the output shaft, the moving member moving in an axial direction of the output shaft in accordance with rotation of the output shaft, the moving member comprising a pin; and a link lever having a first end fixed to the control shaft and a second end formed with a slit, the slit being engaged with the pin, wherein the control shaft is rotated through the link lever in accordance with axial movement of the moving member, and wherein when the valve is under control of small operating angle, an angle formed between the link lever and the output shaft is decreased.

14. A variable-valve-actuation (VVA) apparatus for an internal combustion engine with a valve, comprising:

a control shaft arranged rotatable in accordance with operating conditions of the engine;

means for changing at least an operating angle of the valve in accordance with rotation of the control shaft; and means for rotating the control shaft, the rotating means comprising means for providing torque and means for reducing the torque, the reducing means having a reduction ratio set to be larger when the valve is under control of small operating angle than when the valve is under control of large operating angle.

15. The VVA apparatus as claimed in claim 2, wherein the output shaft and the motor are axially slidable relative to one another.

16. The VVA apparatus as claimed in claim 15, wherein the output shaft and the motor are configures to rotate in synchronization with each other.

17. The VVA apparatus as claimed in claim 16, wherein the output shaft and the motor are serration-coupled coaxially to each other.

18. A variable-valve-actuation (VVA) apparatus for an internal combustion engine with a valve, comprising:

a control shaft arranged rotatable in accordance with operating conditions of the engine;

an alteration mechanism which changes at least an operating angle of the valve in accordance with rotation of the control shaft;

a drive mechanism which rotates the control shaft, the drive mechanism comprising an electric motor and a reduction mechanism; and a controller configured to cause the motor to rotate so that the reduction mechanism is set to a larger reduction ratio when the valve is under control of small operating angle than when the valve is under control of large operating angle.

* * * * *